US009409370B2

(12) United States Patent
Koehn et al.

(10) Patent No.: US 9,409,370 B2
(45) Date of Patent: Aug. 9, 2016

(54) DEVICE FOR PRODUCING BAGS FROM HOSE-SHAPED MATERIAL

(75) Inventors: Uwe Koehn, Osnabrueck (DE); Manfred Tautz, Tecklenburg (DE); Manfred Mueller, Lengerich (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 793 days.

(21) Appl. No.: 13/146,501

(22) PCT Filed: Jan. 14, 2010

(86) PCT No.: PCT/EP2010/050396

§ 371 (c)(1), (2), (4) Date: Aug. 30, 2011

(87) PCT Pub. No.: WO2010/086232

PCT Pub. Date: Aug. 5, 2010

(65) Prior Publication Data

US 2012/0108409 A1 May 3, 2012

(30) Foreign Application Priority Data

Jan. 28, 2009 (DE) ..... 10 2009 000 454

(51) Int. Cl.
*B31B 19/10* (2006.01)
*B31B 29/00* (2006.01)
(Continued)

(52) U.S. Cl.
CPC ..... *B31B 19/10* (2013.01); *B31B 29/00* (2013.01); *B31B 37/00* (2013.01); *B31B 2219/022* (2013.01); *B31B 2221/20* (2013.01); *B31B 2237/20* (2013.01); *B31B 2237/60* (2013.01)

(58) Field of Classification Search
CPC ..... B31B 1/00; B31B 1/29; B31B 1/02; B29C 65/18
USPC ..... 493/12, 16, 267, 255, 269, 288, 308, 493/218, 219, 186, 363
See application file for complete search history.

(56) References Cited

U.S. PATENT DOCUMENTS 2,753,769 A * 7/1956 Burroughs ..... 493/213
3,373,664 A * 3/1968 Brockmuller ..... 493/218
(Continued)

FOREIGN PATENT DOCUMENTS

CH 425434 5/1967
DE 29 21 605 1/1980
(Continued)

*Primary Examiner* — Andrew M Tecco
*Assistant Examiner* — Praachi M Pathak
(74) *Attorney, Agent, or Firm* — Jacobson Holman, PLLC.

(57) ABSTRACT

An apparatus for producing bags from tubular material having fabric made of stretched plastic strips has at least one tube-forming device or a tube-unwinding device, by which tubular material for producing bags can be produced from web-shaped material and in which the tubular material, can be conveyed in a transport direction (x'), at least one tube-separating device, by which tube pieces can be separated from the tubular material, a bottom-forming device, by which bottoms can be molded onto at least one end of a tube piece, and at least one transport device for transporting the tube pieces within the bottom-forming device in a transport direction (x) extending transversely to their direction of extension (y) The transport direction (x') of the tubular material in the tube-forming device or the tube-unwinding device and the transport direction (x) of the tube pieces in the transport device are parallel to each other.

11 Claims, 3 Drawing Sheets

(51) Int. Cl.

| | |
|---|---|
| ***B31B 37/00*** | (2006.01) |
| ***B31B 1/00*** | (2006.01) |
| ***B31B 1/02*** | (2006.01) |

(56) References Cited

U.S. PATENT DOCUMENTS

| | | | | | |
|---|---|---|---|---|---|
| 3,433,135 | A | * | 3/1969 | Lokey et al. | 493/12 |
| 3,524,389 | A | * | 8/1970 | Stork | 493/16 |
| 3,583,296 | A | * | 6/1971 | Stork et al. | 493/12 |
| 3,599,538 | A | * | 8/1971 | Piazze | 493/194 |
| 3,618,477 | A | | 11/1971 | Piazze | |
| 3,656,513 | A | * | 4/1972 | Evans et al. | 138/141 |
| 3,871,270 | A | * | 3/1975 | Kuckhermann et al. | 493/393 |
| 3,916,769 | A | * | 11/1975 | Turunen | 493/227 |
| 4,137,528 | A | * | 1/1979 | Traise | 340/675 |
| 4,240,336 | A | | 12/1980 | Grevich et al. | |
| 4,582,506 | A | * | 4/1986 | Milsmann et al. | 493/12 |
| 4,645,339 | A | * | 2/1987 | Feldkamper | 356/237.1 |
| 5,782,731 | A | * | 7/1998 | Kohn et al. | 493/16 |
| 5,857,954 | A | | 1/1999 | Achelpohl et al. | |
| 6,328,683 | B1 | * | 12/2001 | Rautenberg | 493/255 |
| 6,892,635 | B2 | * | 5/2005 | Herbert | 101/225 |
| 7,302,787 | B2 | * | 12/2007 | Iwasa et al. | 53/504 |
| 8,597,167 | B2 | * | 12/2013 | Haeger et al. | 493/218 |
| 2008/0274867 | A1 | * | 11/2008 | Welp | 493/186 |

FOREIGN PATENT DOCUMENTS

| | | |
|---|---|---|
| DE | 195 02 251 | 8/1996 |
| DE | 10 2006 041 275 | 3/2008 |

* cited by examiner

DEVICE FOR PRODUCING BAGS FROM HOSE-SHAPED MATERIAL

CROSS-REFERENCE TO RELATED APPLICATIONS

This is a national stage of PCT/EP10/050396 filed Jan. 14, 2010 and published in German, which claims the priority of German number 10 2009 000 454.8 filed Jan. 28, 2009, hereby incorporated by reference.

BACKGROUND OF THE INVENTION

1. Field of Invention

The invention relates to an apparatus for producing bags from tubular material comprising fabric made of stretched plastic strips. The apparatus has at least one tube-forming device or a tube-unwinding device, by which tubular material, for producing bar can be produced from web-shaped material and in which the tubular material can he conveyed in a transport direction (x'), and at least one tube-separating device, by which tube pieces can be separated from the tubular material, and a bottom-forming device, by which bottoms can be molded onto at least one end of a tube piece, and at least one transport device for transporting the tube pieces within the bottom-forming device in a transport direction (x) extending transversely to their direction of extension (y). The invention also relates to a method of producing bags from web-shaped material with the help of at least one tube-forming device or a tube-unwinding device. In the method, the tubular material is conveyed in a transport direction (x'), and tube pieces are separated from the tubular material with the help of at least one tube-separating device. Bottoms are molded onto at least one of a tube piece in a bottom-forming device, and the tube pieces are transported within the bottom-forming device with the help of at least one transport device in a transport direction (x) extending transversely to the direction of extension (y) of the tube pieces.

2. Description of the Prior Art

Such apparatuses are known in the prior art and have been available on the market for quite a while now. These apparatuses usually first comprise a tube-forming device for producing and providing tubular material. Provision can also be made for only a tube-unwinding device. This device can usually be equipped with a spool, on which tubular material is wound. The material is mostly drawn off continuously from this spool in the longitudinal direction.

In the bag-making process carried out on machines known in the prior art, the fabric tube provided by the tube-forming device or the tube-unwinding device is supplied to the cross cutter that separates the fabric tube into individual tube pieces. The tube pieces are transferred to a transport device. The original transport direction, in which the tube or the tube pieces are transported in the direction of their longitudinal axes, is altered with the help of this transport device to a new transport direction so that the tube pieces are no longer transported in the direction of their longitudinal axes, but instead transversely thereto so that the ends of the tube pieces can be reached laterally for the purpose of molding the bottoms. The original and the new transport directions of the tube or the tube piece are located at right angles to each other.

As mentioned above, the tubular fabric material that can additionally be coated is separated into tube pieces. When producing the tube pieces, the tube is drawn cyclically in its longitudinal direction by the length of each tube piece. In order to enable the cyclical drawing of the tube, there is a compensating device provided in the form of at least one movable deflecting rod provided between the spool of material and the separating device. A tube piece is then isolated, thus separated, from the tube. This step is usually carried out by means of a cutting tool such as a blade. Other separation processes and the associated devices are also feasible. The aforementioned spool of material often comprises a fabric tube made of circular woven material. The tube produced on a circular loom is collapsed after its production and provided with a coating that ensures that portions of the tube piece can be heat-sealed together without damaging the stretched fabric and affecting its strength adversely.

The tube-forming device molds tubular material in that the edges of the material web are placed on top of each other and joined together, for example, by means of a plastic extrusion. In this process, both the flat material web and the tube are transported in the longitudinal direction. The tubular material is made of two superimposed material webs, each of which can comprise a number of layers. The aforementioned tube-forming device can further be able to insert side gussets. Bags provided with side gussets are advantageous when they are to be stacked in the filled state. The major advantage in producing tubes from woven and coated flat material is that coating material does not protrude laterally over the edges of the flat tube, as is often the case when collapsed, circular woven tubular material is coated. Protruding coating material frequently results in errors when producing bags from pieces of the tubular material.

The tube piece produced in the manner described above is received by at least one transport device in order to deliver them to the individual processing stations. After being separated from the tubular material, the tube pieces are no longer transported further in the longitudinal direction, but instead in the transverse direction. The term "transverse direction" is understood to mean that the tube pieces are now transported in a direction extending transversely to their longitudinal extension in order to obtain unobstructed access to both ends of the tube pieces in the further steps carried out for producing bags.

The individual processing stations used in the bag-making process are listed below together with an explanation of their functions.

- In an optionally provided pre-creasing station, form punches are lowered onto the tube piece for producing fold lines. The turned-in corners of the opened tube bottom will later be located on these fold lines. The form punches can also be heated for this purpose.
- In the bottom-opening station, at least one end of a tube piece is raised so that a bottom can be molded onto this raised end. The turned-in corners are located on the fold lines of the tube piece. Due to its geometric shape, the bottom opening is also called the bottom square. It should be noted here that the shape of the bottom opening is not square, but rectangular in most cases. Both ends of a tube piece are usually processed in a similar manner.
- In the valve patch station, a valve patch is applied to the previously opened bottom of the tube piece. The valve patch enables the finished bag to be filled later with the help of a suitable fill nozzle.
- In a so-called closing station, parts of the bottom openings or the bottom squares, the so-called tabs, are folded back on both sides toward the folded edge. In doing so, portions of these tabs can overlap each other, and these overlapping portions of these tabs can be joined together.
- A bottom patch is then attached, for example heat-sealed to the folded bottom opening in the bottom patch station.

It should be mentioned here that all the stations listed above need not be present in an apparatus for producing bags. It is thus possible to dispense with a pre-creasing station. It is also not required to always apply bottom patches in order to produce a bag. Nonetheless, the apparatus may also comprise additional processing stations. As mentioned above, in the bag-making process carried out on bag-making apparatuses known in the prior art, the fabric tube provided by the tube-forming device is supplied to the cross cutter that separates the fabric tube into individual tube pieces. The tube pieces are transferred to a transport device. The original transport direction, in which the tube or the tube pieces are transported in the direction of their longitudinal axes, is altered with the help of this transport device to a new transport direction so that the tube pieces are no longer transported in the direction of their longitudinal axes, but instead transversely thereto so that the ends of the tube pieces can be reached laterally for the purpose of molding the bottoms. The original and the new transport direction of the tube or the tube piece are located at right angles to each other. It is for this reason that the tube-forming device and the aforementioned processing stations are also disposed or set up so as to extend at right angles to each other.

The arrangement of the tube-forming device so as to extend at right angles to the processing stations is disadvantageous. The floor space of production halls is usually rectangular, and therefore such an arrangement of devices takes up space.

SUMMARY OF THE INVENTION

It is therefore an object of the present invention to suggest an apparatus for producing bags from tubular material, which apparatus can be set up in a more space-saving manner.

According to the invention, this object is achieved by the features of the invention described herein.

Thus the transport direction of the tubular material in the tube-forming device and the transport direction of the tube pieces in the transport device are oriented so as to extend parallel to each other. The term "parallel" can be understood to mean that the transport directions are oriented so as to extend in the opposite or same direction. The former option is interesting if an elongated, narrow factory work room is available. The second option is recommended for rather broad but short factory work rooms. The term "parallel" is further understood to mean the horizontal component of the direction of movement. A vertical component of movement remains unaffected thereby.

The tube-forming device conveys the tubular material along the longitudinal axis of the tube. Since the processing stations have to reach the ends of the individual tube pieces, it is advantageous to transport the tube pieces to the processing stations in a direction extending transversely to their longitudinal axes. Therefore it is particularly advantageous if at least one deflecting device is provided between the tube-forming device and the bottom-forming device, by means of which deflecting device the tubular material can be deflected upstream of the cross cutter in a new transport direction which extends, at least in part, transversely to the original transport direction. Thus the tube can already be conveyed in the direction that corresponds to the position of the tube pieces that is required for the subsequent processing of the tube pieces. By contrast, it would be possible to separate the tube in the transport direction to form tube pieces and to rotate these tube pieces individually or in groups, which, however, is time-consuming and thus expensive as compared to the solution suggested by the invention. The deflected tube can then be separated into individual tube pieces that are now supplied to the processing stations in a direction of movement extending transversely to their longitudinal axes. A tube-unwinding device can also be provided according to the present invention.

In a particularly preferred embodiment of the invention, the position of the deflecting device that enables a deflection of the tubular material can be altered. More particularly, the deflecting device can be moved in the original transport direction of the tubular material. The advantage of this feature is that the position of the edges of variably broad material tubes can be adjusted to suit the cross cutter or the separating device. Particularly in the case of tubes produced in a tube-forming device, the central position is identical in most cases, irrespective of the width of the tube. However, the transport device collects the tube pieces at their front lateral edges so that it is not the centerline but the front edges that must assume a constant position irrespective of the width of the tube. This is achieved very easily as a result of the movability of the deflecting device. Nonetheless, it is feasible to provide a number of deflecting elements, the inclination angle of which is alterable relative to the transport direction of the tubular web. The position of the front edges of the tubes can also be adjusted in this way.

Advantageously, the deflecting device is an air turning bar known per se. The air turning bar can comprise bores, upon which air acts so that the tubular material can be guided by means of the turning bar without coming into contact with the same.

In a preferred embodiment of the invention, the separating device and the deflecting device are located at a distance from each other in the vertical direction. Preferably, the deflecting device is located above the separating device. The deflecting device can also be positioned below the separating device. This enables the tube-forming device and the additional tube piece-processing stations to be set up or disposed directly one behind the other—in a line. In this case, the geometric centerlines of the tubes and the tube pieces are also located in a line, which likewise prevents space from being used up unnecessarily. More particularly, the arrangement of the deflecting device below the separating device enables the transport direction of the tube to be altered by means of only one deflecting device disposed obliquely in the transport direction of the tube. It is particularly advantageous if the deflecting device is disposed above the separating device. The tubes can be guided at the level of the separating device by means of transport rollers, the rotation axes of which are disposed so as to extend transversely to the transport direction of the tube.

In a further preferred embodiment of the invention, the tube-forming device comprises a storage device disposed upstream of the deflecting device in the transport direction of the tube. Tubular material that was produced beforehand by the tube-forming device can be stored by means of the storage device. Thus, for example, in the case of a malfunction of the tube-forming device or in the case of a change of the material spool, the individual processing stations (more particularly, the tube-separating device) can continue to be supplied with tubular material without having to stop the process of bag production. It is also possible, within certain limits, to store additional tubular material if it becomes necessary to stop the processing stations.

In a further advantageous embodiment, the tube-forming device comprises a winding unit, by means of which the tubular material produced beforehand can be wound up into a spool. The tube-forming device can operate in an off-line mode—that is, without the supply of tubular material to the processing stations.

In the off-line operation, the processing stations can also be fed by a tube-unwinding device with tubular material. The unwinding device comprises a spool of tubular material and is not connected to the tube-forming device. The spool of material can be produced beforehand by the tube-forming device.

Thus the apparatus for producing bags can be operated in two alternative modes. In the so-called in-line operation, the cross cutter is supplied directly by the tube-forming device with tubular material. In the off-line operation, the apparatus for producing bags—as described above—is supplied with material from a separate spool of tubular material that can be produced by the tube-forming device in the manner described above. In this way, the aforementioned components of the apparatus for producing bags can be operated with the maximum flexibility possible. This flexibility is required particularly, for example, when carrying out maintenance work on individual components of the apparatus for producing bags.

In a further preferred embodiment, the tube-forming device comprises a device for the detection of material defects. Defective tube regions can be detected by the device for detecting material defects. The defective regions of the tube can include seams thereof that are leaky. These leaky seams can result, for example, when the edges of the material webs are glued together erroneously in the tube-forming device. Defective tube regions can also include faults in the fabric or errors in the coating of the flat material that is made into the tubular material. An incorrect width of a tube can also be recognized as a defective tube region.

It is advantageous if a reject gate is provided downstream of the tube-separating device in the transport direction of the tubular material. Tube pieces comprising defective regions can be removed by means of this reject gate.

In a further advantageous embodiment of the invention, a control device is provided, to which data can be fed from the device for the detection of material defects by means of a suitable data line. These data include information on the defective regions of the tubular material described above.

Advantageously, the device for detecting material defects is disposed upstream of the separating device. Advantageously, the reject gate is located directly downstream of the tube-separating device.

Advantageously, the reject gate is activated by the control device when the device for detecting material defects detects a defective region (and transmits information about the same to the control device) and the tube section in question has been separated. The reject gate now receives the tube section instead of the transport device. In this case, the defective tube piece is eliminated before it can travel to the individual processing stations and be processed to form a bag. This timely elimination of defective tube pieces can therefore save a good deal of energy and time since defective tube pieces are not processed to form bags.

Additional exemplary embodiments of the invention are explained below in the present description and the claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
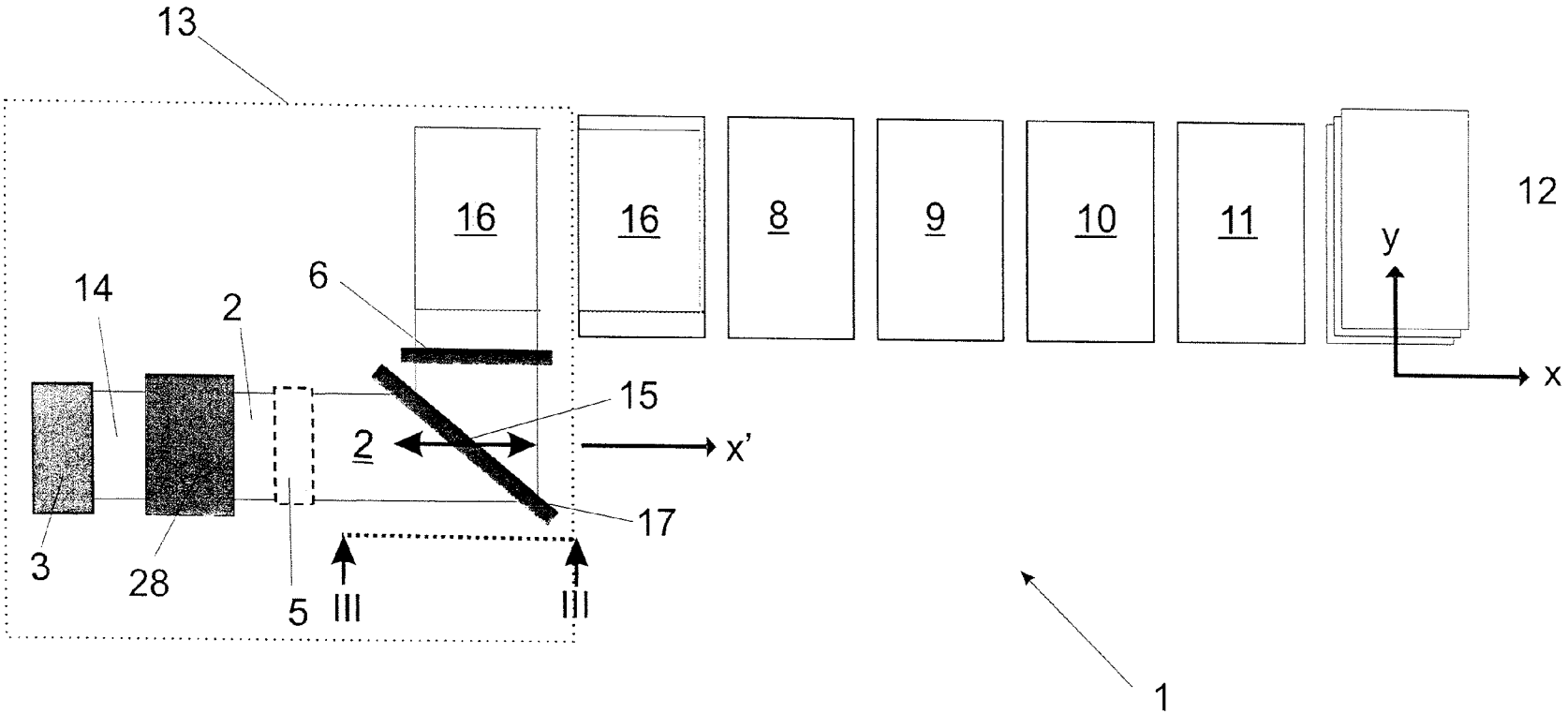
FIG. 1 is a schematic diagram of an apparatus for producing fabric bags

FIG. 1 diagrammatically shows the individual steps for processing a fabric tube to form bags as carried out in the bag-making apparatus 1.

The tube-forming device 13 comprises a spool 3 containing web-shaped material 14. The web-shaped material 14 is supplied to a tube-forming region 28 in the transport direction x'. Here 28, the web-shaped material is folded back onto itself in a manner known per se, and the edges are glued or heat-sealed together so that a material tube 2 is formed. Then the tube 2 is provided with a so-called opening in the opening station 5. For this purpose, the fabric tube is guided around an internal tool that separates the two layers from each other so that the layers are isolated from each other if they have been glued together in any of the production steps of the tube 2. Only in the case of separate layers can it be ensured that the subsequent production steps are carried out properly. The material layers of the tube 2 that are separated from each other are then again placed on top of each other.

In the further course of transport, the tubular material web 2 is supplied to a deflecting device, preferably at least one turning bar 17. The turning bar 17 is movable in the direction of the double arrow 15. The material tube 2 is deflected with the help of the turning bar 17 from the original transport direction x' into the transport direction y, and supplied to a cross cutter 6 that separates the fabric tube into individual tube pieces 16.

Then the tube pieces 16 are transported in a transport direction x extending transversely to their longitudinal axes so that the ends of the tube pieces can be reached laterally by the related processing stations for the purpose of molding the bottoms.

The transport direction x' of the tubular material 2 and the transport direction x of the tube piece 16 extend parallel to each other.

The parallel course of the transport direction x' of the tubular material and the transport direction x of the tube piece also enables the tube-forming device to be arranged so as to extend parallel to the processing stations. This enables a very compact and space-saving design of the bag-producing apparatus. Likewise, the parallelism of the directions of movement x' and x enables the tube-forming device and the individual processing stations to be set up directly one behind the other and thus a long but slender bag-production line to be achieved.

In the subsequent station, the bottom-opening station 8, both ends of every tube piece are opened and the so-called bottom squares are placed. In the subsequent valve station 9, a valve is fitted and attached to one of the two open ends. The open bottoms are now closed in the bottom-closing station 10, two tabs being placed on top of each other and joined together permanently, for example, by means of a heat-sealing process. The application of a bottom patch to the bottom of each bag in the bottom patch station 11 marks the conclusion of the actual bag-making process. Furthermore, the bottom patches can likewise be welded onto the bottoms of the bags. The finished bags are then placed on the stack 12 and removed from here in a manner not described in detail.

Figure 3:
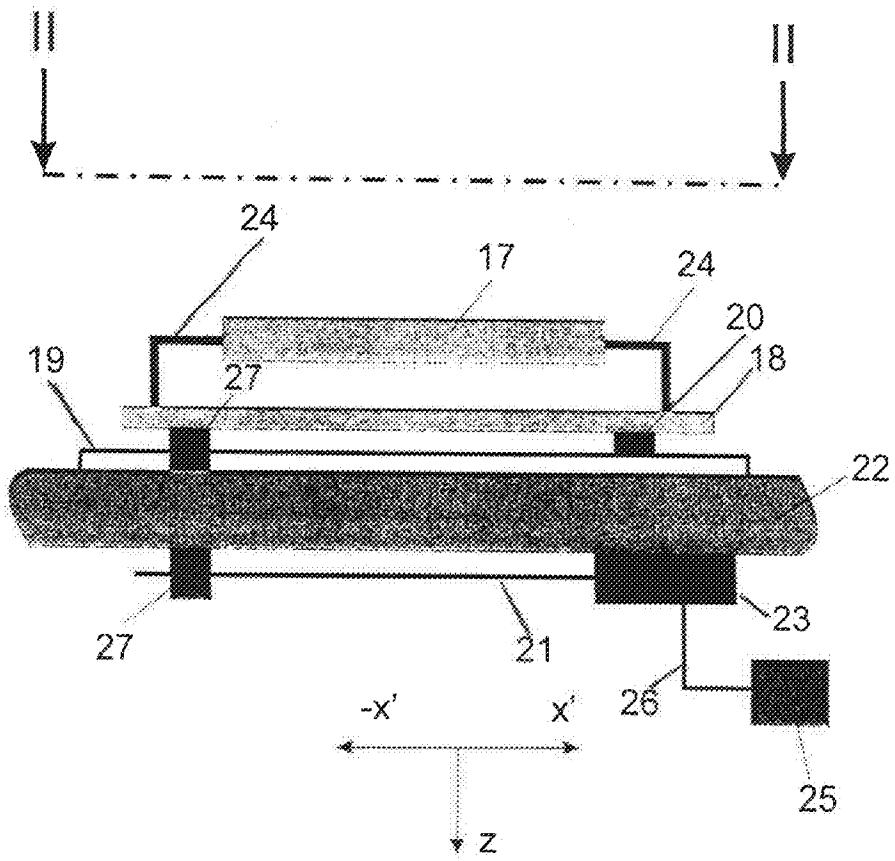
FIG. 3 shows a section taken along marked in FIG. 1
Figure 2:
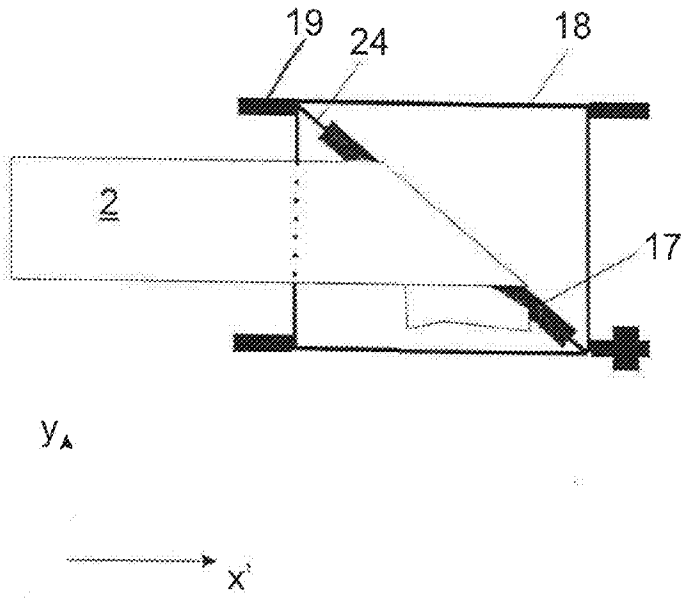
FIG. 2 is a top view of the turning bar

FIG. 2 is a top view of the turning bar 17. The turning bar can be mounted for rotation on a holding frame 18 by means of a holder 24. In the exemplary embodiment shown here, the holding frame 18 is located in a plane that extends parallel to the direction of movement of the tubular material 2. Slides 20, 27 that engage in rails 19 (FIG. 3) are mounted below the holding frame 18. The holding frame 18 can be moved on the rails 19 with the help of the slides 20, 27. The slide 27 is extended in the z direction. At the bottom end of the extended slide 27 there is a spindle nut inserted, in which a spindle 21 engages. The spindle 21 is rotatable with the help of the motor 23. As a result of a rotation of the spindle 21 that engages in the spindle nut of the extended slide 27, the holding frame—and thus also the turning bar 17 mounted for rotation thereon—can be moved in the x' and −x' direction. As a result of the movability of the turning bar in a direction (in the x' and −x' direction) extending parallel to the direction of movement of the tubular material 2, the position of the edges of variably broad material tubes can be adjusted to suit the cross cutter or the separating device 6.

The spindle motor 23 is connected to a control device 25 by means of a suitable data line 26. The width dimensions of the material tubes to be processed can be stored in the control device. A manual input of these width dimensions is also possible. During a job change, the control device 25 controls the spindle motor 23 based on the width dimensions of the tubular material in such a way that the turning bar 17 is moved in the x' direction until the position of the edges of the tubular material is adjusted to suit the cross cutter or the separating device 6.

Figure 4:
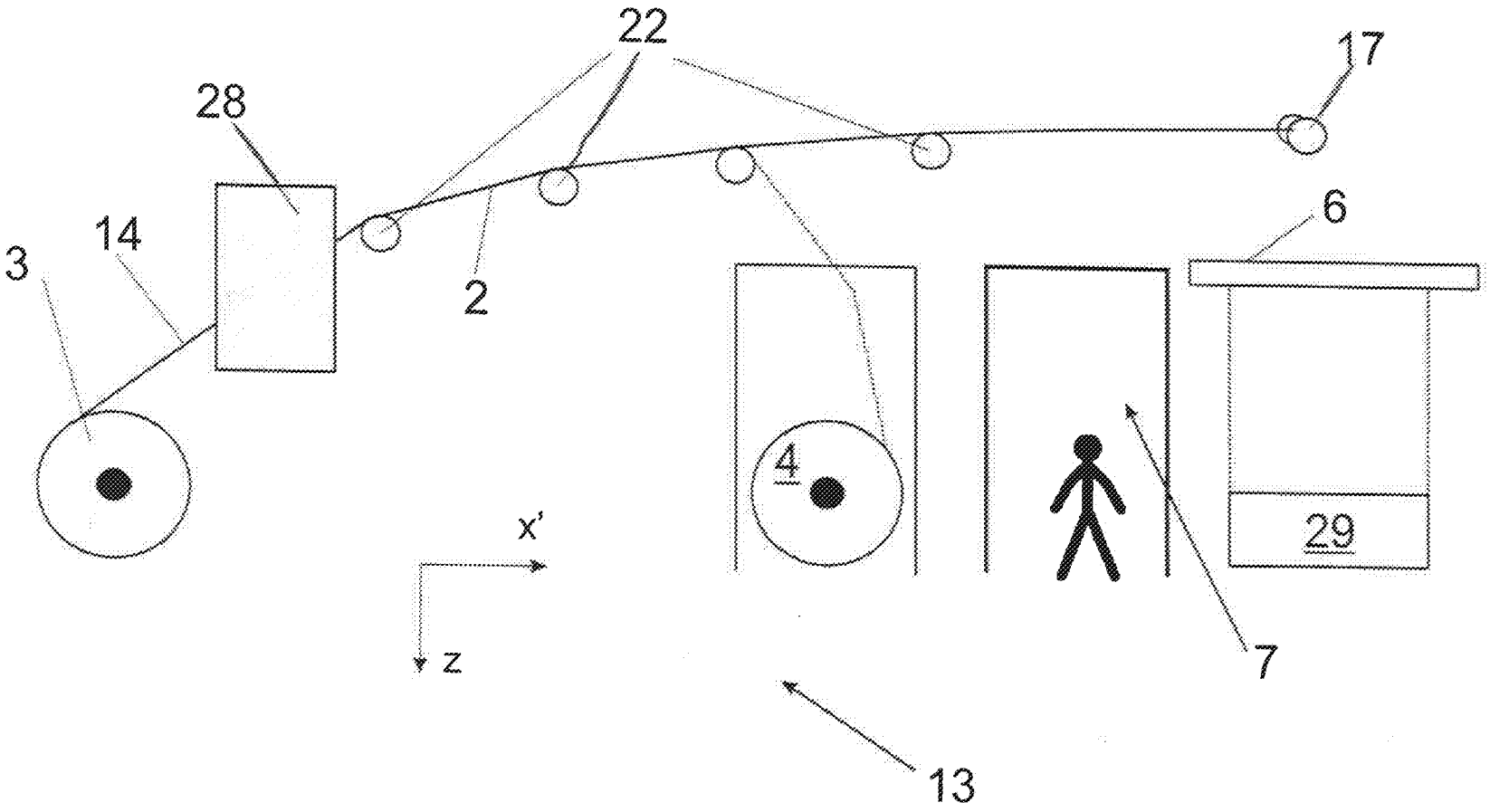
FIG. 4 is a side view of the tube-forming device

FIG. 4 is a side-view of a tube-forming device 13. The web-shaped material 14 is unwound from a spool 3 and supplied to a tube-forming region 28, which is not described in more detail and in which 28 the web-shaped material 14 is processed to form tubular material 2. Then the tubular material travels by means of guide rollers 22 to the turning bar 17. Alternatively, web-shaped material can also be wound up on a spool 4 in the so-called off-line mode. As mentioned above, the material tube 2 is deflected with the help of the turning bar 17 from the original transport direction x' to the transport direction y and supplied to a cross cutter 6 that separates the fabric tube into individual tube pieces 16. With reference to FIG. 4, it is apparent that the turning bar is located in a plane above the cross-cutter. The separating device or the cross cutter 6 can also be supplied with tubular material from a separate material spool 29. The bag-making apparatus can be operated in two modes. In the so-called in-line mode, the cross cutter 6 is directly supplied with web-shaped material by the tube-forming device 13—by means of the turning bar 17. In the so-called off-line mode, the cross cutter is supplied with tubular material by a separate spool 29. The tubular material can be produced beforehand by the tube-forming device 13 and wound up into a spool 4. In this case, the spool 4 would then be brought into the position of the spool 29 for producing the bags.

Below the guided rollers 22 a passageway 7 is located, which 7 can be traversed by the operating personnel. The operating personnel of the bag-making apparatus can thus access both sides of the machine without having to move around the complete machine. This feature is particularly advantageous since the overall machine length is increased as a result of the tube-forming device 13 and the individual tube piece-processing stations being placed one behind the other. The position of the passageway directly next to the separating device or the cross cutter 6 is advantageous since the operator can thus reach the cross cutter 6 more easily and eliminate any cases of material compression, for example. Furthermore, both spools 4 and 29 of tubular material can be accessed by the operator from here. This feature is advantageous both when errors occur as well as when changing a spool of material.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of reference numerals | |
|---|---|
| 1 | Bag-making apparatus |
| 2 | Tubular material |
| 3 | Spool |
| 4 | Spool comprising tubular material |
| 5 | Opening station |
| 6 | Tube-separating device |
| 7 | Passageway |
| 8 | Bottom-opening station |
| 9 | Valve patch station |
| 10 | Bottom-closing station |
| 11 | Bottom-patch station |
| 12 | Bag stack |
| 13 | Tube-forming device |
| 14 | Web-shaped material |
| 15 | Double arrow |
| 16 | Tube piece |
| 17 | Turning bar |
| 18 | Holding frame |
| 19 | Rails |
| 20 | Slide |
| 21 | Spindle |
| 22 | Guide rollers |
| 23 | Spindle motor |
| 24 | Holder |
| 25 | Control device |
| 26 | Data line |
| 27 | Slide |
| 28 | Tube-forming region |
| 29 | Spool comprising tubular material |
| X' | Transport direction |
| X | Transport direction |

What is claimed is:

1. An apparatus for producing bags from tubular material, having fabric made of stretched plastic strips, said apparatus comprising:

at least one tube-forming device or a tube-unwinding device, by which tubular material for producing bags can be produced from web-shaped material and in which the tubular material can be conveyed in a transport direction (x'), at least one tube-separating device, by which tube pieces can be separated from the tubular material, a bottom-forming device, by which bottoms can be molded onto at least one end of a tube piece, and at least one transport device for transporting the tube pieces within the bottom-forming device in a transport direction (x) extending transversely to their direction of extension (y), with the transport direction (x') of the tubular material in the tube-forming device or the tube-unwinding device and the transport direction (x) of the tube pieces in the transport device being parallel to each other, and with a deflecting device that includes a turning bar being located between the tube forming device or the tube-unwinding device and the bottom-forming device, the deflecting device (i) deflecting the tubular material in a new transport direction (y) extending, at least in part, transversely to the transport direction (x') and (ii) being repositionable in the transport direction (x') of the tubular material.

2. The apparatus accordlng to claim 1, wherein the separating device and the deflecting device are located at a distance from each other in a vertical direction.

3. The apparatus according to claim 1, wherein the separating device and the deflecting device are located above each other.

4. The apparatus according to claim 1, wherein the tube-forming device includes a winding unit with which the tubular material can be wound up into a spool.

5. The apparatus according to claim 1, wherein the tube-forming device or the tube-unwinding device includes a storage device with which tubular material can be stored and supplied to the tube-separating device.

6. The apparatus according to claim 1, wherein the tube-forming device or the tube-unwinding device includes a device for detecting material, defects and with which defective tube regions are detectable.

7. The apparatus according to claim 6, further comprising, for removal of defective tube pieces, a reject gate downstream of the tube-separating device, in the transport direction (x', x) of the tubular material.

8. The apparatus according to claim 7, further comprising a control device to which data can be fed via a data line from a device for detection of material defects.

9. The apparatus accord claim 8, wherein the reject gate can be activated by the control device based on the data of the device for the detection of material defects in such a way that the defective tube pieces can be eliminated.

10. A method of producing bags from tubular material having fabric made of stretched plastic strips, comprising:

producing tubular material for the production of bags from web-shaped material with at least one tube-forming device or a tube-unwinding device and conveying the tubular material in a transport direction (x'), separating tube pieces from the tubular material with at least one tube-separating device, molding bottoms onto at least one end of a tube piece in a bottom-forming device, the tube pieces being transported within the bottom-forming device with at least one transport device in a transport direction (x) extending transversely to a direction of extension (y) of the tube pieces, the tubular material being transported in the tube-forming device or the tube-unwinding device and the tube pieces being transported in the transport device, parallel to each other in a direction of movement (x', x), and with a deflecting device that includes a turning bar (i) located between the tube-forming device or the tube-unwinding device and the bottom-forming device and (ii) repositionable in the transport direction (x') of the tubular material, deflecting the tubular material in the transport direction (y) extending, at least in part, transversely to the transport direction (x'), and adjusting a position of an edge of the tubular material to have a constant position regardless of a width of the tubular material.

11. The method according to claim 10, wherein the separating device and the deflecting device are located at a distance from each other in a vertical direction.

* * * * *